United States Patent [19]

Yoshikawa

[11] Patent Number: 4,612,885

[45] Date of Patent: Sep. 23, 1986

[54] CAMSHAFT BEARING ARRANGEMENT FOR OVERHEAD CAM ENGINE

[75] Inventor: Masaaki Yoshikawa, Iwata, Japan

[73] Assignee: Yamaha Hatsudoki Kabushiki Kaisha, Iwata, Japan

[21] Appl. No.: 721,799

[22] Filed: Apr. 10, 1985

[30] Foreign Application Priority Data

Apr. 11, 1984 [JP] Japan ..... 59-70953

[51] Int. Cl.[4] ..... F01L 1/00

[52] U.S. Cl. ..... 123/90.27; 123/193 CH; 123/193 H

[58] Field of Search ..... 123/90.27, 90.6, 193 CH, 123/193 H

[56] References Cited

U.S. PATENT DOCUMENTS

| | | | |
|---|---|---|---|
| 4,291,650 | 9/1981 | Formia et al. | 123/90.27 |
| 4,430,968 | 2/1984 | Futakuchi et al. | 123/90.27 |
| 4,534,325 | 8/1985 | Tanaka | 123/90.27 |

FOREIGN PATENT DOCUMENTS

| | | | |
|---|---|---|---|
| 98180 | 1/1984 | European Pat. Off. | 123/90.27 |
| 3009302 | 9/1980 | Fed. Rep. of Germany | 123/90.27 |
| 143128 | 8/1983 | Japan | 123/90.27 |

*Primary Examiner*—Ira S. Lazarus

*Attorney, Agent, or Firm*—Ernest A. Beutler

[57] ABSTRACT

An arrangement for rotatably supporting first and second camshafts associated with first and second series of plural valves for the combustion chamber of an internal combustion engine. A cylinder head is affixed to the cylinder block by fastening means that are equally spaced with respect to the cylinder bores while the camshafts are offset at different distances from the cylinder bore axis on opposite sides of the cylinder head. The fastening arrangement includes cam carriers and bearing caps that support the respective camshafts and which are spaced so as to avoid interference with each other and to provide uniform tightening loads.

20 Claims, 4 Drawing Figures

CAMSHAFT BEARING ARRANGEMENT FOR OVERHEAD CAM ENGINE

BACKGROUND OF THE INVENTION

This invention relates to a camshaft bearing arrangement for an overhead camshaft engine and more particularly to an improved assembly arrangement for the camshaft and other associated components of the engine.

The advantages of overhead camshafts and multiple valve engines for achieving high performance are well acknowledged. In spite of the acknowledged advantages, certain practical aspects have limited the use of overhead camshaft, multiple valve engines for large production volumes. One of the main difficulties in such applications is the positioning of the various components in such a manner as to provide a compact assembly and nevertheless one which can be conveniently manufactured, assembled and serviced. For example, it is desirable to position the camshafts in such a way that they do not substantially increase the width of the cylinder head assembly. However, this gives rise to certain difficulties in connection with the journaling for the camshafts and maintaining adequate clearance and accessibility for the fasteners that secure the cylinder head to the cylinder block. Recently, it has also been proposed to provide more than two intake valves for each cylinder of the engine and the use of three or more intake valves gives rise to additional problems in connection with the camshaft mounting arrangement. It is desirable if the valves can be displaced in such a way so as to operated by a single camshaft. However, if this is done, the intake camshaft may be spaced at a different distance from the center line of the engine than the exhaust camshaft and this can give rise to certain additional difficulties in locating the various fasteners for the engine.

It is, therefore, a principal object of this invention to provide an improved camshaft bearing arrangement for overhead cam engines.

It is a yet further object of this invention to provide an improved camshaft bearing construction for an engine wherein the fasteners for the various components are conveniently located and yet do not interfere with each other.

SUMMARY OF THE INVENTION

A first feature of this invention is adapted to be embodied in an assembly for an internal combustion engine comprising a cylinder block, a cylinder head detachably affixed to the cylinder block by a plurality of threaded fastening means, a plurality of poppet valves supported for reciprocation by the cylinder head and a camshaft for operating the poppet valves. In accordance with this feature of the invention, a cam carrier is detachably affixed to the cylinder head and overlies at least one of the threaded fastening means that secure the cylinder head to the cylinder block. A bearing cap is affixed to the cam carrier and the cam carrier and the bearing cap have bearing surfaces that journal the camshaft.

Another feature of the invention is adapted to be embodied in an assembly for an internal combustion engine that comprises a cylinder block, a cylinder head detachably affixed to the cylinder block by a plurality of first threaded fastening means, a plurality of poppet valves supported for reciprocation by the cylinder head and a camshaft for operating the poppet valves. In accordance with this feature of the invention, a cam carrier is detachably affixed by second threaded fastening means to the cylinder head. A bearing cap is detachably affixed to the cam carrier by third threaded fastening means and the cam carrier and bearing cap have bearing surfaces that journal the camshaft.

Another feature of the invention is adapted to be embodied in an assembly for internal combustion engines comprising a cylinder block, a cylinder head detachably affixed to the cylinder block by a plurality of threaded fastening means, a first set of poppet valves supported for reciprocation by the cylinder head on one side of a plane containing the cylinder bore axis and a second set of poppet valves supported for reciprocation on the opposite side of the plane. A pair of spaced camshafts are provided for operating respective sets of the poppet valves. In accordance with this feature of the invention, a cam carrier is detachably affixed to the cylinder head. A first series of bearing caps are affixed to the cam carrier and journal the first of the camshafts for rotation about a rotational axis that is offset from the plane by a first distance. A second series of bearing caps are detachably affixed to the cam carrier and journal the second camshaft for rotation about a rotational axis that is offset from the plane by a distance that is different than the distance of offset of the first camshaft rotational axis.

DETAILED DESCRIPTION OF THE PREFERRED EMBODIMENT

Figure 1:
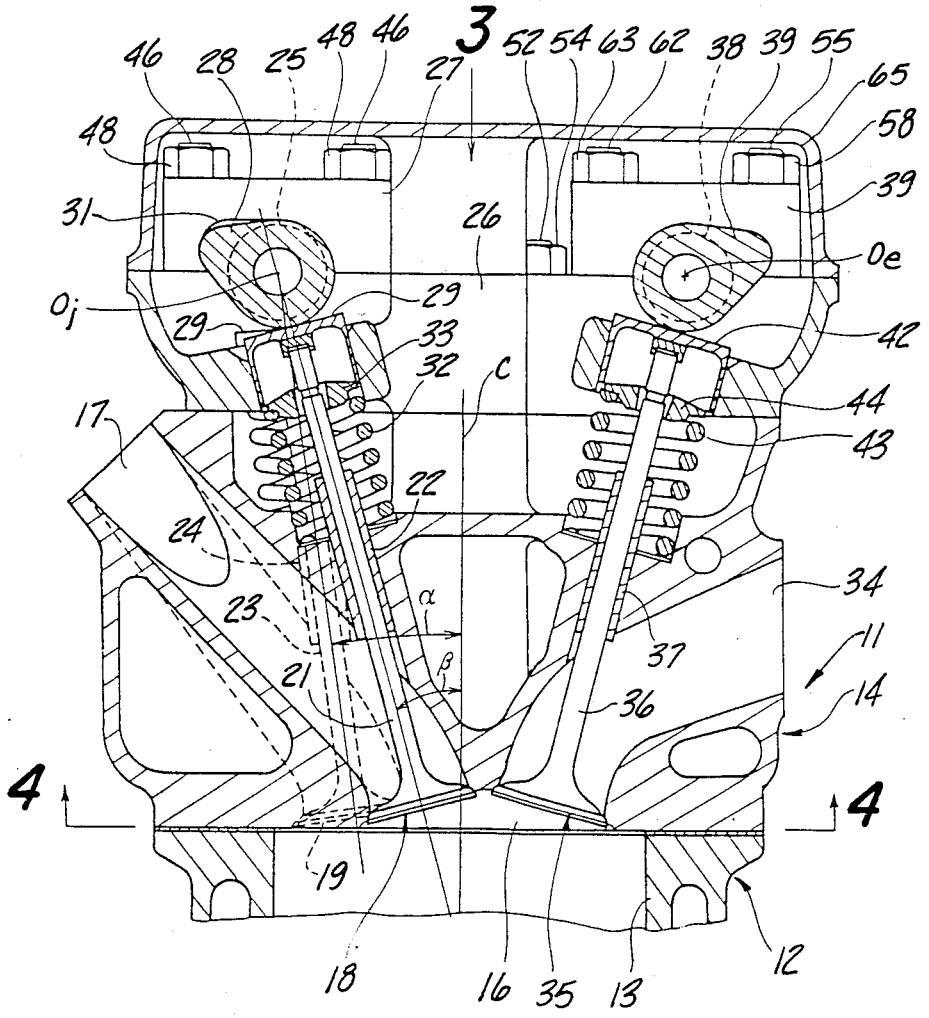
FIG. 1 is a cross-sectional view through a cylinder of an internal combustion engine constructed in accordance with an embodiment of the invention and is taken generally along the line 1—1 of FIG. 3.

An internal combustion engine constructed in accordance with an embodiment of the invention is identified generally by the reference numeral 11. Inasmuch as the invention is directed primarily toward the valve train and its actuating mechanism, only this portion of the engine has been shown in detail. It is to be understood that the remaining, unshown portions of the engine are conventional.

The engine 11 includes a cylinder block assembly, indicated generally by the reference numeral 12, in which one or more cylinder bores 13 are formed. In the illustrated embodiment, only one of the cylinders has been shown, however, it is to be understood that the invention can be utilized with engines having other numbers of cylinders and various cylinder configurations. A piston (not shown) is supported for reciprocation within each cylinder bore 13 and it rotatably coupled to a crankshaft in a known manner.

A cylinder head assembly is affixed to the cylinder block 12 and the cylinder head assembly includes a main cylinder head casting, indicated generally by the reference numeral 14. The cylinder head 14 is affixed to the cylinder block 12 by means of a plurality of threaded fasteners 15, which in the illustrated embodiment, comprise bolts that are threaded into suitable threaded openings in the cylinder block 12. Each series of threaded fasteners 15 is disposed so as to be equally spaced around the cylinder bore axis, indicated by the dimension C. There are four threaded fasteners 15 associated with each cylinder bore 13. If the engine comprises more than two cylinders and they are in line, it should be understood that adjacent pairs of cylinders will share adjacent pairs of threaded fasteners, as is well known in this art.

The cylinder head 14 is formed with individual cavities 16 that cooperate with the cylinder bores 13 and respective pistons to form variable volume chambers. At times, the cavities 16 will be referred to as the combustion chambers.

The cylinder head 15 is formed with intake passages 17 that communicate with each combustion chamber 16. The intake passages 17 may be either a plurality of separate intake passages or may comprise a single intake passage that branches into three separate passages that terminate in respective intake ports. Valve sets (not shown) are pressed into the cylinder head 14 and define the termination of the individual intake ports. Two of the intake ports are disposed closer to a plane perpendicular to FIG. 1 and containing the axis of the cylinder bore 13, which plane is identified by the line C. The remaining intake port is disposed between these two first mentioned intake ports and is spaced farther from the plane C. The configuration may be best seen in FIG. 4.

Intake valves 18 cooperate with valve seats formed in the first two mentioned intake ports so as to control the flow of intake charge into the combustion chamber 16. An intake valve 19 cooperates with a valve seat formed at the remaining intake port. The intake valves 18 reciprocate along respective parallel axes defined by their stems 21. The stems 21 of the intake valves 18 are supported for reciprocation along these axes by valve guides 22 that are pressed into the cylinder head 14. The intake valve 19 for each cylinder 13 reciprocates along an axis as defined by its stem 23 supported in a valve guide 24 that is also pressed into the cylinder head 14. The axis of the valve 19 is not parallel to the axes of the valves 18 for a reason to be described.

The axes of the valves 18 and 19 all intersect the axis of rotation $O_i$ of an intake camshaft, indicated generally by the reference numeral 25. The intake camshaft 25 is supported for rotation in a cam tower or cam carrier 26 that is affixed to the cylinder head 14 in a manner to be described. Bearing caps 27 are affixed at spaced locations, as will be described, to the cam tower 26 and cooperate with the cam tower to journal the intake camshaft 25.

Because the intake valve axes intersect the axis of rotation $O_i$ of the camshaft 25, it is possible to directly operate each of the intake valves 18 and 19. The camshaft 35 is provided with a first pair of lobes 28 that engage tappet followers 29 that are reciprocally supported in the cam tower 26 and which contact the stems of the intake valves 18 for their direct actuation. The camshaft 25 is also provided with a lobe 31 between the lobes 28 which lobe 31 cooperates with a tappet follower 29 for directly actuating the intake valve 19.

Valve springs 32 encircle the stems of each of the intake valves 18 and 19 and act against keeper spring retainer assemblies 33 for urging the valves 18 and 19 to their closed positions.

The reciprocal axes of the intake valves 18 lie at an angle $\beta$ to the plane C (FIG. 1). The axis of the intake valve 19 lies at an angle $\alpha$ to the plane C. The angle $\beta$ is greater than the angle $\alpha$. That is, the axes of the intake valves 18 are at a greater angle to the cylinder bore axis than is the axis associated with the intake valve 19. As a result, the intake valve 19 is spaced radially outwardly from the plane C toward the peripheral edge of the cylinder bore 13, as clearly shown in FIG. 4. This arrangement permits the three intake valves 18, 19 all to reciprocate between their open and closed positions without interference with each other, while at the same time maximizing intake valve area. Due to this different angle relative to the camshaft rotational axis $O_i$, the cam lobe 31 is advanced relative to the cam lobes 28 so that all intake valves 18 and 19 will be operated simultaneously. Of course, if desired, a different valve timing might be employed. Since the axes of the valves 18 and 19 all intersect the camshaft axis $O_i$, it is possible to operate more than two intake valves from the same camshaft.

Exhaust passages 34 extend through the side of the cylinder head 14 opposite to the intake passages 17. There are a pair of exhaust passages 34 associated with each cylinder bore 13 in connection with the illustrated embodiment. The exhaust passages 34 terminate in exhaust ports and valve seats. Exhaust valves 35 cooperate with the valve seats and exhaust ports for controlling the communication of the combustion chamber 16 with exhaust passages 34. The exhaust valves 35 are supported for reciprocation about respective axes defined by their stems 36 that cooperate with valve guides 37 pressed into the cylinder head 14.

The exhaust valve axes are parallel and intersect the axis of rotation $O_e$ of an exhaust camshaft 38. The exhaust camshaft 38 is rotatably journaled in the cam tower 26 and is journaled by the cam tower 26 and bearing caps 39 that are affixed in a manner to be described. The exhaust camshaft 38 is provided with lobes 41 that engage tappet followers 42 which, in turn, directly actuate the exhaust valves 35.

Valve springs 43 encircle the exhaust valves 35 and engage keeper spring retainer assemblies 44 for urging the exhaust valves 35 to their closed position.

Figure 4:
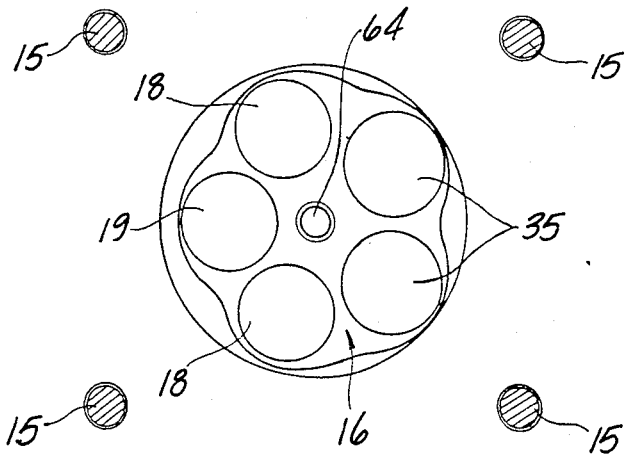
FIG. 4 is a view looking generally in the direction of the line 4—4 in FIG. 1 and shows the combustion chamber configuration in relation to the cylinder head holddown studs.

As may be readily seen from FIG. 4, the centers of the exhaust valves 35 lie on a plane that is offset from the plane C on the side opposite the intake valves 18 and 19. A portion of the heads of the valves 18 also extend cross the plane C. As a result of this spacing, the centers of the intake valves 18 and 19 are disposed closer to the plane C than the centers of the exhaust valves 35. For this same reason, the rotational axis $O_i$ of the intake camshaft 25 is disposed closer to the plane C than the rotational $O_e$ of the exhaust camshaft 35.

Figure 2:
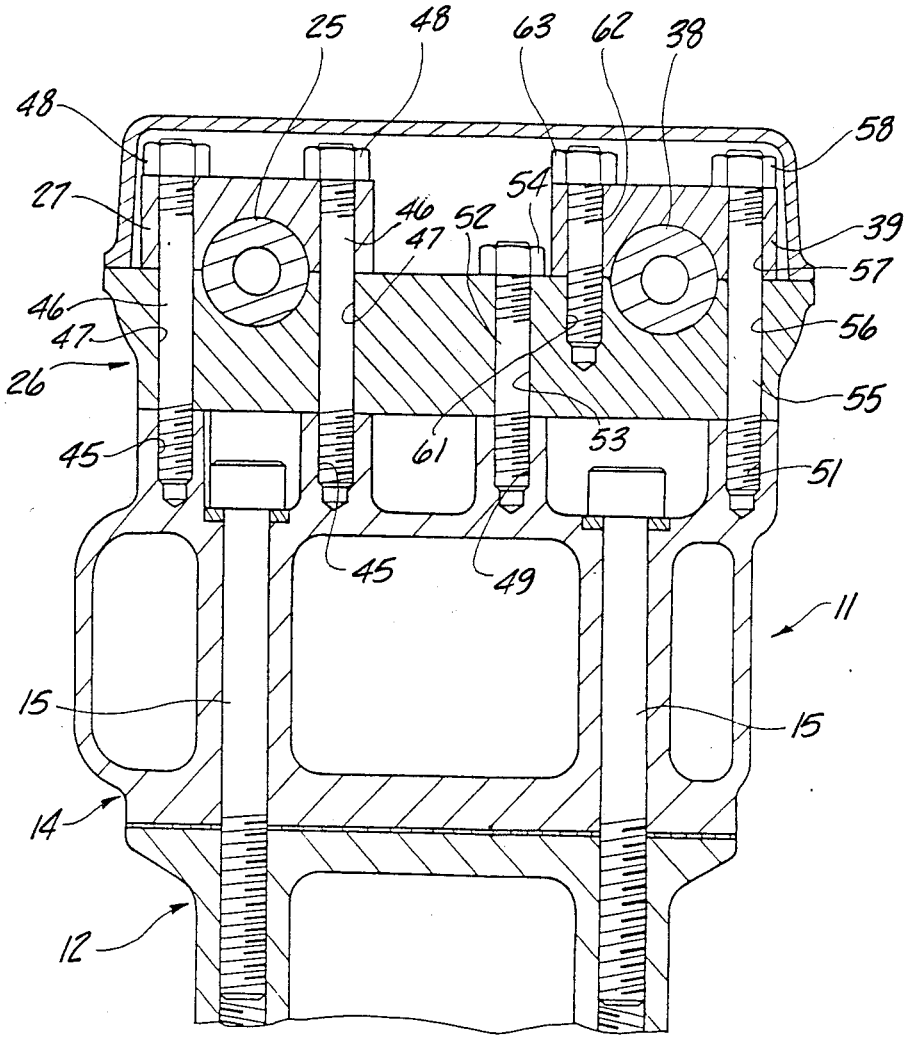
FIG. 2 is a cross-sectional view taken along the line 2—2 of FIG. 3.
Figure 3:
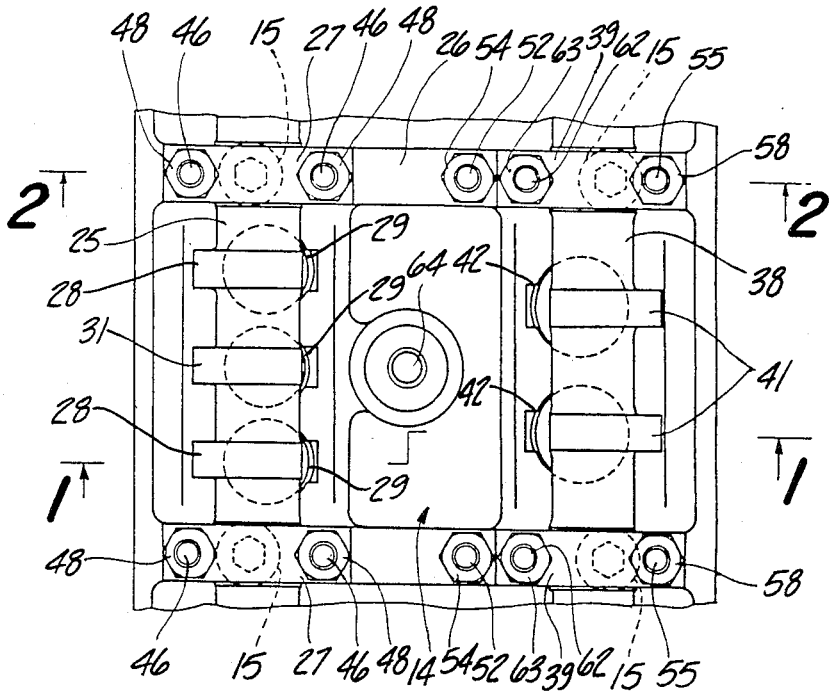
FIG. 3 is a top plan view of the engine with the camshaft cover removed and looking generally in the direction of the arrow 3 in FIG. 1.

It is the normal practice to position the cylinder head hold-down fasteners 15 so that they are equally spaced from the cylinder bore center C so as to insure good clamping loads for the cylinder head gasket and to minimize distortion. Because of the offset relationship of the camshaft rotational axis $O_i$ and $O_e$, the camshaft 25 lies substantially over its adjacent pair of cylinder head fasteners 15 while the camshaft 38 is disposed generally outwardly with respect to its respective fasteners 15 as clearly shown in FIG. 2. An arrangement is provided to hold the bearing halves 25 and 39 to the cam carrier 26 and cam carrier 26 to the cylinder head 14 to minimize unequal loadings. This arrangement will now be described by primary reference to FIGS. 2 and 3.

Because of the generally centralized relationship of the intake camshaft 25 with respect to its adjacent fasteners 15, it is possible to use the same fastener assembly for securing the bearing caps 27 to the cam carrier 26 and the cam carrier 26 to the cylinder head assembly 14. The cylinder head assembly 14 is provided with tapped openings 45 that are disposed generally on opposite sides of the heads of the respective fasteners 15 and longitudinally aligned with them. Studs 46 are threaded into the tapped openings 45 and pass through respective bores 47 formed in the cam carrier 26. These studs 46 further extend through corresponding bores formed in the bearing caps 27 and have threaded upper ends that are engaged by nuts 48 so as to secure the bearing caps 27 to the cam carrier 26 and the cam carrier 26 and bearing caps 27 to the cylinder head assembly 14.

The exhaust side of the cylinder head assembly 15 is provided with tapped openings 49 and 51 that are disposed on opposite sides of the fasteners 15 and are spaced equally from the centers of the fasteners 15. The openings 49 and 51 are spaced apart, however, a greater distance than the tapped openings 45 associated on the intake side of the cylinder head. A series of first studs 52 are threaded into the openings 49 and extend through bores 53 formed in the cam carrier 26. Nuts 54 are affixed to the threaded upper ends of the studs 52 for securing the cam carrier 26 directly to the cylinder head assembly 14 by means of the studs 53.

Longer studs 55 are threaded into the tapped openings 51 and extend through bores 56 formed in the cam carrier 26 and complementary bores 57 formed in the bearing caps 39. Nuts 58 are affixed to the upper ends of the studs 55 for securing the bearing caps 39 to the cam carrier 26 and these two elements to the cylinder head assembly 14.

The cam carrier 26 is formed with a series of tapped openings 61 that are formed on the other side of the exhaust camshaft 38 from the bores 56 and at equal distance from the rotational axis $O_e$ of the camshaft 38 as the bored openings 56. Short studs 62 are threaded into the tapped openings 61 and have nuts 63 engaged with their upper ends so as to further affix the bearing caps 39 to the cam carrier 26.

It should be readily apparent from the aforegoing description that the fastening and mounting arrangement for the camshafts permits equal loading of all bearing caps, provides no interference between the cam tower and bearing cap hold-down assemblies relative to the cylinder head hold-down fasteners 15 and otherwise affords a good and easily serviced construction.

The cylinder head assembly 14 is provided with a tapped spark plug opening 64 approximately on the axis C of the cylinder bore 13 so as to permit a spark plug to be positioned with its gap centrally of the combustion chamber 16. A cam cover 65 is affixed in a suitable manner to the cam carrier 26 so as to close the cylinder head assembly and enclose the cam shafts 25 and 38.

It should be readily apparent from the foregoing description that a very effective arrangement has been provided for facilitating rotational support for a pair of overhead camshafts that are not in the same spacing from the cylinder bore axis so as to insure good loading and also, at the same time, facilitate servicing. Although an embodiment of the invention has been illustrated and described, various changes and modifications may be made without departing from the spirit and scope of the invention, as defined by the appended claims.

I claim:

1. In an assembly for an internal combustion engine comprising a cylinder block, a cylinder head detachably affixed to said cylinder block by a plurality of threaded fastening means, a plurality of poppet valves supported for reciprocation in said cylinder head, and a camshaft for operating said poppet valves, the improvement comprising a cam carrier detachably affixed to said cylinder head and overlying said threaded fastening means, and a bearing cap affixed to said cam carrier, said cam carrier and said bearing cap having bearing surfaces for journaling said camshaft.

2. In an assembly as set forth in claim 1 wherein the axis of rotation of the camshaft overlies the threaded fastening means.

3. In an assembly as set forth in claim 1 wherein the camshaft is displaced at one side of the cylinder head and overlies a first series of threaded fastening means affixing that side of the cylinder head to the cylinder block.

4. In an assembly as set forth in claim 2 wherein the means for fixing the bearing cap to the cam carrier includes threaded fastening means threaded into the cylinder head and affixing the bearing cap to the cam carrier and the bearing cap and cam carrier to the cylinder head.

5. In an assembly as set forth in claim 4 wherein the threaded fastening means comprises studs threaded into the cylinder head and nuts engaging the bearing caps.

6. In an assembly for an internal combustion engine comprising a cylinder block, a cylinder head detachably affixed to said cylinder block by a plurality of first threaded fastening means, a plurality of poppet valves supported for reciprocation by said cylinder head, and a cam shaft for operating said poppet valves, the improvement comprising a cam carrier detachably affixed by second threaded fastening means to said cylinder head and a bearing cap detachably affixed to said cam carrier by third threaded fastening means, said cam carrier and said bearing cap having bearing surfaces for journaling said camshaft.

7. In an assembly as set forth in claim 6 wherein the camshaft overlies the first threaded fastening means.

8. In an assembly as set forth in claim 7 wherein the camshaft is offset to one side of the cylinder bore axis and overlies a series of the first threaded fastening means affixing that side of the cylinder head axis to the cylinder block.

9. In an assembly as set forth in claim 6 wherein the third threaded fastening means is threadingly engaged with the cylinder head for affixing the bearing cap and the cam carrier to the cylinder head.

10. In an assembly as set forth in claim 9 wherein the third threaded fastening means comprises studs threaded into the cylinder head.

11. In an assembly as set forth in claim 10 further including fourth threaded fastening means for affixing the bearing cap to the cam carrier, said third and said fourth threaded fastening means being disposed at equal distances on opposite sides of the rotational axes of the camshaft, said second and said third threaded fastening means being disposed at equal distances from the first fastening means.

12. An internal combustion engine comprising a cylinder block, a cylinder head detachably affixed to said cylinder block by a plurality of threaded fastening means, a first set of poppet valves supported for reciprocation by said cylinder head on one side of a plane containing the cylinder bore axis, a second set of poppet valves supported for reciprocation on the opposite side of said plane, first and second spaced camshafts each associated with a respective one of said sets of poppet valves for operating said respective poppet valves, a cam carrier detachably affixed to said cylinder head, a first series of bearing caps affixed to said cam carrier and journaling said first camshaft for rotation about a rotational axis offset from said plane by a first distance, and a second series of bearing caps detachably affixed to said cam carrier and journaling said second camshaft for rotation about a rotational axis that is offset from said plane by a different distance than the distance of offset of said first camshaft rotational axis and on the other side of said plane.

13. An internal combustion engine as set forth in claim 12 wherein there is a first series of threaded fastening means affixing the cylinder head to the cylinder block and a second series of threaded fastening means for affixing said cylinder head to said cylinder block, said first and said second series of threaded fastening means being disposed at equal distance to the plane and on opposite sides thereof.

14. An internal combustion engine as set forth in claim 13 wherein the axis of rotation of the first camshaft overlies the first series of threaded fastening means.

15. An internal combustion engine as set forth in claim 14 wherein the means for fixing the first series of bearing caps to the cam carrier includes a third series of threaded fastening means threaded into the cylinder head and affixing said first series of bearing caps to the cam carrier and said first series of bearing caps and said cam carrier to the cylinder head.

16. An internal combustion engine as set forth in claim 15 wherein the third series of threaded fastening means comprises studs threaded into the cylinder head and nuts engaging the bearing caps.

17. An internal combustion engine as set forth in claim 13 wherein the cam carrier is detachably affixed by a third series of threaded fastening means to said cylinder head and the second series of bearing caps are detachably affixed to said cam carrier by fourth threaded fastening means.

18. An internal combustion engine as set forth in claim 17 wherein the second camshaft overlies the second series of threaded fastening means.

19. An internal combustion engine as set forth in claim 18 wherein the fourth threaded fastening means is threadingly engaged with the cylinder head for affixing the second series of bearing caps and the cam carrier to the cylinder head.

20. An internal combustion engine as set forth in claim 19 wherein the fourth threaded fastening means comprises studs threaded into the cylinder head.

* * * * *